US008550241B2

(12) United States Patent
Holford

(10) Patent No.: US 8,550,241 B2
(45) Date of Patent: Oct. 8, 2013

(54) PACKAGE FOR SMOKING ARTICLES

(75) Inventor: Steven Holford, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 12/937,811

(22) PCT Filed: Mar. 17, 2009

(86) PCT No.: PCT/EP2009/053152
§ 371 (c)(1),
(2), (4) Date: Feb. 9, 2011

(87) PCT Pub. No.: WO2009/127486
PCT Pub. Date: Oct. 22, 2009

(65) Prior Publication Data

US 2011/0155595 A1 Jun. 30, 2011

(30) Foreign Application Priority Data

Apr. 14, 2008 (GB) ..... 0806691.2

(51) Int. Cl.
*B65D 85/10* (2006.01)

(52) U.S. Cl.
USPC ..... 206/268; 206/273; 229/148; 229/160.1

(58) Field of Classification Search
USPC ..... 206/1.5, 242, 249, 261, 263, 265, 206/268, 271, 273; 229/87.13, 123, 160.1, 229/148
See application file for complete search history.

(56) References Cited

U.S. PATENT DOCUMENTS

| | | | | |
|---|---|---|---|---|
| 3,326,447 | A * | 6/1967 | Williamson | 229/125.08 |
| 3,881,599 | A * | 5/1975 | Flaherty | 206/273 |
| 4,232,816 | A | 11/1980 | Johnson et al. | |
| 4,588,081 | A * | 5/1986 | Newsome et al. | 206/251 |
| 5,014,906 | A * | 5/1991 | Gero | 229/123 |
| 6,334,532 | B1 * | 1/2002 | Tambo et al. | 206/268 |
| 6,719,131 | B1 * | 4/2004 | Focke et al. | 206/268 |

(Continued)

FOREIGN PATENT DOCUMENTS

| | | |
|---|---|---|
| CN | 1181342 A | 5/1998 |
| EP | 1829799 A | 9/2007 |

(Continued)

OTHER PUBLICATIONS

International Search Report and Written Opinion corresponding to PCT/EP2009/053152 mailed May 15, 2009.

(Continued)

*Primary Examiner* — Luan K Bui
(74) *Attorney, Agent, or Firm* — N W Poulsen

(57) ABSTRACT

A package for smoking articles comprising an inner shell (2) and an outer shell (1), the inner shell defining a space for smoking articles and the outer shell defining a cavity to receive the inner shell, the inner and outer shells being hingedly connected such that they pivot relative to each other from a closed position in which the inner shell is received in the outer shell and an open position in which the inner shell extends from the outer shell, wherein the outer shell includes a sidewall that overlaps a sidewall (13) of the inner shell when the inner and outer shells are in their closed position, a recess (56) being formed in the sidewall of one of the inner or outer shells and a tab (60) extending from a corresponding sidewall of the inner or outer shell such that, when the inner and outer shells are in their closed position, the tab locates in said recess.

39 Claims, 6 Drawing Sheets

(56) References Cited

U.S. PATENT DOCUMENTS

| | | | | |
|---|---|---|---|---|
| 6,837,369 | B2 * | 1/2005 | Amos | 206/273 |
| 7,377,385 | B2 * | 5/2008 | Giannini et al. | 206/267 |
| 2008/0087712 | A1 * | 4/2008 | Hunt et al. | 229/87.13 |
| 2010/0270185 | A1 * | 10/2010 | Berger et al. | 206/268 |

FOREIGN PATENT DOCUMENTS

| | | | |
|---|---|---|---|
| EP | 1829799 | A2 | 9/2007 |
| JP | S52041091 | A | 3/1977 |
| WO | WO2006/061563 | A1 | 6/2006 |

OTHER PUBLICATIONS

International Preliminary Report on Patentability corresponding to PCT/EP2009/053152 mailed May 7, 2010.

Office Action, related CN patent application No. 200980113201, dated Sep. 27, 2011.

Office Action dated Sep. 27, 2011 for corresponding application CN200980113201, filed Mar. 17, 2009.

Office Action for corresponding application JP2011504399, filed Feb. 2011.

* cited by examiner

PACKAGE FOR SMOKING ARTICLES

CLAIM FOR PRIORITY

This application is a National Stage Entry entitled to and hereby claims priority under 35 U.S.C. §§365 and 371 to corresponding PCT Application No. PCT/EP2009/053152, filed Mar. 17, 2009, which in turn claims priority to British Application Serial No. GB 0806691.2, filed Apr. 14, 2008. The entire contents of the aforementioned applications are herein expressly incorporated by reference.

The present invention relates to a package and to blanks for making the package. In particular, the invention relates to a clam-shell package for smoking articles, but is not limited thereto.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products but is not limited thereto. The smoking article may be provided with a filter for the gaseous flow drawn by the smoker.

Clam-shell packets and the like are known to those skilled in the art and are used in the cigarette industry for holding cigarettes. Such packets are generally formed from a cardboard blank, or multiple cardboard blanks, and generally hold ten to twenty individual cigarettes in a predetermined arrangement.

A clam-shell packet typically comprises an outer shell and an inner shell, which are hingedly connected such that they can rotate relative to each other along a common edge between an 'open' position, wherein smoking articles disposed in a smoking article receiving space defined in the inner shell are accessible, and a 'closed' position, wherein smoking articles disposed in a smoking article receiving space defined in the inner shell are inaccessible. The outer shell defines a cavity which contains the inner shell when the packet is disposed in the closed position, such that sidewalls of the outer shell are disposed against sidewalls of the inner shell and a top wall and front wall of the outer shell enclose the opening formed in the inner shell to access the smoking article receiving space.

In conventional clam-shell packets, the inner shell is retained in the outer shell by means of the outer surface of the sidewalls of the inner shell frictionally engaging with the inner surface of the sidewalls of the outer shell.

However, in such a clam-shell packet, discussed above, the sidewalls of the inner and outer shells may not sufficiently frictionally engage with each other to retain the inner shell in a closed position within the outer shell. Therefore, in an attempt to overcome this problem, the inner shell may be retained in the outer shell by means of a spring mechanism. One such example of such a clam-shell packet is known from the Applicant's own earlier international patent application published as WO 2006/061563. This document discloses a clam-shell packet with a spring mechanism, the inner and outer shells being connected by a spring member arranged so that the inner shell is urged into the closed position within the outer shell and is also urged into the open position, extending out of the outer shell and, when moved, springs between an open and closed positions under the action of the spring member.

However, a problem with such a clamshell packet is that the spring may fail and may not be strong enough to hold the inner shell in the outer shell. A further disadvantage of conventional clam-shell packets is that the inner shell is not actually 'locked' in the outer shell in a fully closed position and a user is not given any tactile or physical indication or feedback that the inner shell is fully received therein. Therefore, the lid is then prone to 'yawning' or 'smiling' wherein the lid is disposed in a partially open position.

The present invention seeks to provide a package for smoking articles that overcomes or substantially alleviates the problems with conventional packages referred to above.

According to the present invention, there is provided a package for smoking articles comprising an inner shell and an outer shell, the inner shell defining a space for smoking articles and the outer shell defining a cavity to receive the inner shell, the inner and outer shells being hingedly connected such that they pivot relative to each other from a closed position in which the inner shell is received in the outer shell and an open position in which the inner shell extends from the outer shell, wherein the outer shell includes a sidewall that overlaps a sidewall of the inner shell when the inner and outer shells are in their closed position, a recess being formed in the sidewall of one of the inner or outer shells and a tab extending from a corresponding sidewall of the inner or outer shell such that, when the inner and outer shells are in their closed position, the tab locates in said recess.

Advantageously, the recess is formed in the sidewall of the outer shell and the tab extends from the sidewall of the inner shell.

Preferably, the inner and outer shells are hingedly connected to each other at one end, the space defined by the inner shell being accessible at an opposing end of the inner shell.

The recess may be defined by a step formed in the sidewall of the outer shell.

Conveniently, the outer shell has a front wall and the sidewall extends from an edge of a front wall with the recess being formed between said step and the front wall of the outer shell.

Advantageously, the outer shell comprises an end wall having a flap attached to a surface of the sidewall, said step being formed by an edge of the flap and a surface of the sidewall to which it is attached.

In one embodiment, the flap is configured so that said edge does not extend up to the front wall, said recess being formed between said edge and said front wall.

In a further embodiment, the flap is configured so that said edge extends parallel to said front wall.

Preferably, the end wall extends from the front wall along a second edge and is substantially perpendicular to the sidewall and the front wall.

Advantageously, the tab extends from a sidewall of the inner shell in a direction towards the sidewall of the outer shell.

In a preferred embodiment, the sidewall of the inner shell is formed from inner and outer overlapping layers attached to each other.

Advantageously, the tab is integral with, and extends from, the inner layer.

Preferably, a cut out is formed in the outer layer to receive the tab and the tab may extend from the outer layer.

Alternatively, the tab may be positioned such that it contacts the flap and is resiliently deformed when the inner and outer shells pivot into a closed position prior to the tab being received in the recess.

In a preferred embodiment, the package is formed from two blanks attached to each other.

Advantageously, the first blank comprises a pair of opposing edge cuts, wherein the opposing edge cuts tessellate with each other.

The sidewall may be an end wall. Alternately, the recess may be formed in the sidewall of the inner shell and the tab may extend from the sidewall of the outer shell.

The tab may be formed on one edge cut of the first blank and a corresponding cut-out is formed in the other edge, such that they tessellate.

Conveniently, the outer shell and inner shell are connected by a hinge member, such that the inner shell springs between the open position and the closed position.

Preferably, the outer shell comprises a pair of opposing sidewalls that overlap corresponding opposing sidewalls of the inner shell when the inner and outer shells are in their closed, wherein each wall has a recess formed thereon and a tab extends from each face, such that, when the lid is closed, the tabs locate in said recesses.

According to the present invention, there is also provided a package containing smoking articles.

Preferred embodiments of the present invention will now be described, by way of example only, with reference to the accompanying drawings, in which.

Figure 1:
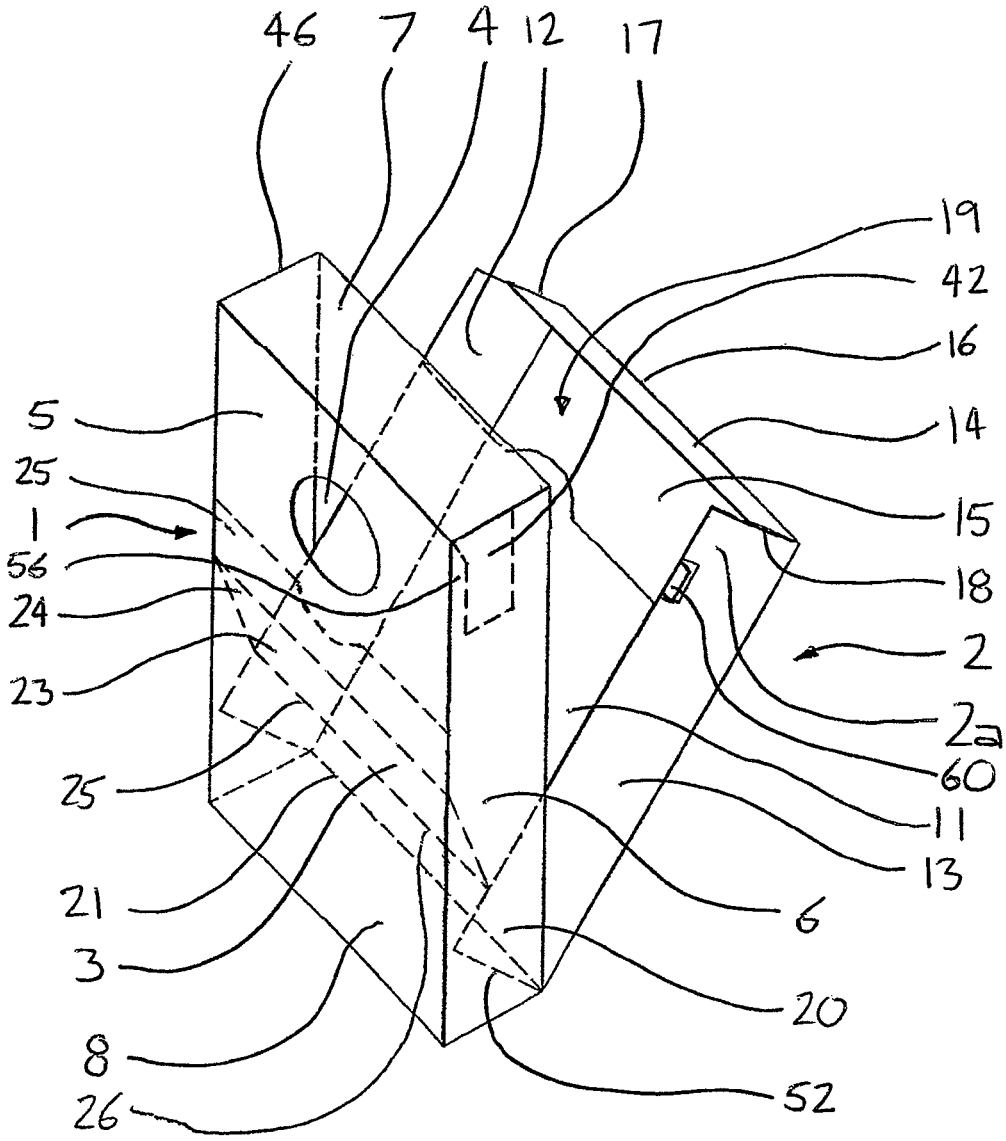
FIG. 1 is a perspective view of a package for smoking articles in accordance with an embodiment of the present invention.

Referring to the drawings, there is shown in FIG. 1 a package for smoking articles according to an embodiment of the present invention comprising an outer shell 1 and an inner shell 2.

The outer shell 1 comprises a front wall 3, a pair of outer shell sidewalls 5, 6, a top wall 7 and a bottom wall 8. The pair of sidewalls 5, 6 oppose each other and extend perpendicularly from the front wall 3 along parallel edges thereof. Similarly, the top wall 7 and bottom wall 8 oppose each other and extend perpendicularly from the front wall 3 along the remaining two parallel edges thereof and extend between the opposing sidewalls 5, 6. An aperture 4 is formed through the front wall 3 extending between an external face and an internal face of the front wall 3 for reasons that will become apparent hereinafter.

The inner shell 2 comprises an inner shell front wall 11, a pair of inner shell sidewalls 12,13, an inner shell top wall 14 and an inner shell rear wall 15. The pair of inner shell sidewalls 12,13 oppose each other and the inner shell front and rear walls 11,15 extend between the pair of inner shell sidewalls 12,13 along edges thereof. The inner shell top wall 14 extends along an upper edge 16 of the inner shell rear wall 15 between upper edges 17,18 of the inner shell sidewalls 12,13. An aperture is formed through the inner shell 2, proximate to an upper end 2*a* of the inner shell 2 because the inner shell front wall 11 and the inner shell top wall 14 do not extend to meet each other to allow access to a smoking article receiving space 19 defined by the inner shell 2.

The inner shell 2 is hingedly mounted to the outer shell 1 at a lower end 20 of the inner shell 2 such that the lower end of the inner shell rear wall 15 is connected to an edge of the outer shell bottom wall 8 along a first hinge line 21.

The outer and inner shells 1,2 are formed from a stiff, resilient material, for example a cardboard or plastic, such that the hinged-lid packet retains its shape and so that the contents (not shown) are protected.

A spring member 23 communicates between the outer and inner shells 1,2 and comprises a spring portion 24 and a mounting flap 25. The spring portion 24 is hingedly connected to the internal face of the front wall 3 by means of the mounting flap 25 which is fixedly attached to the inner face of the front wall 3 by an adhesive. The other end of the spring portion 24 is hingedly connected to a lower end of the front wall 11 of the inner shell 2 at a second hinge line 26, such that the spring member 23 biases the outer shell 1 and the inner shell 2 towards and away from each other, as will become apparent hereinafter.

Figure 2:
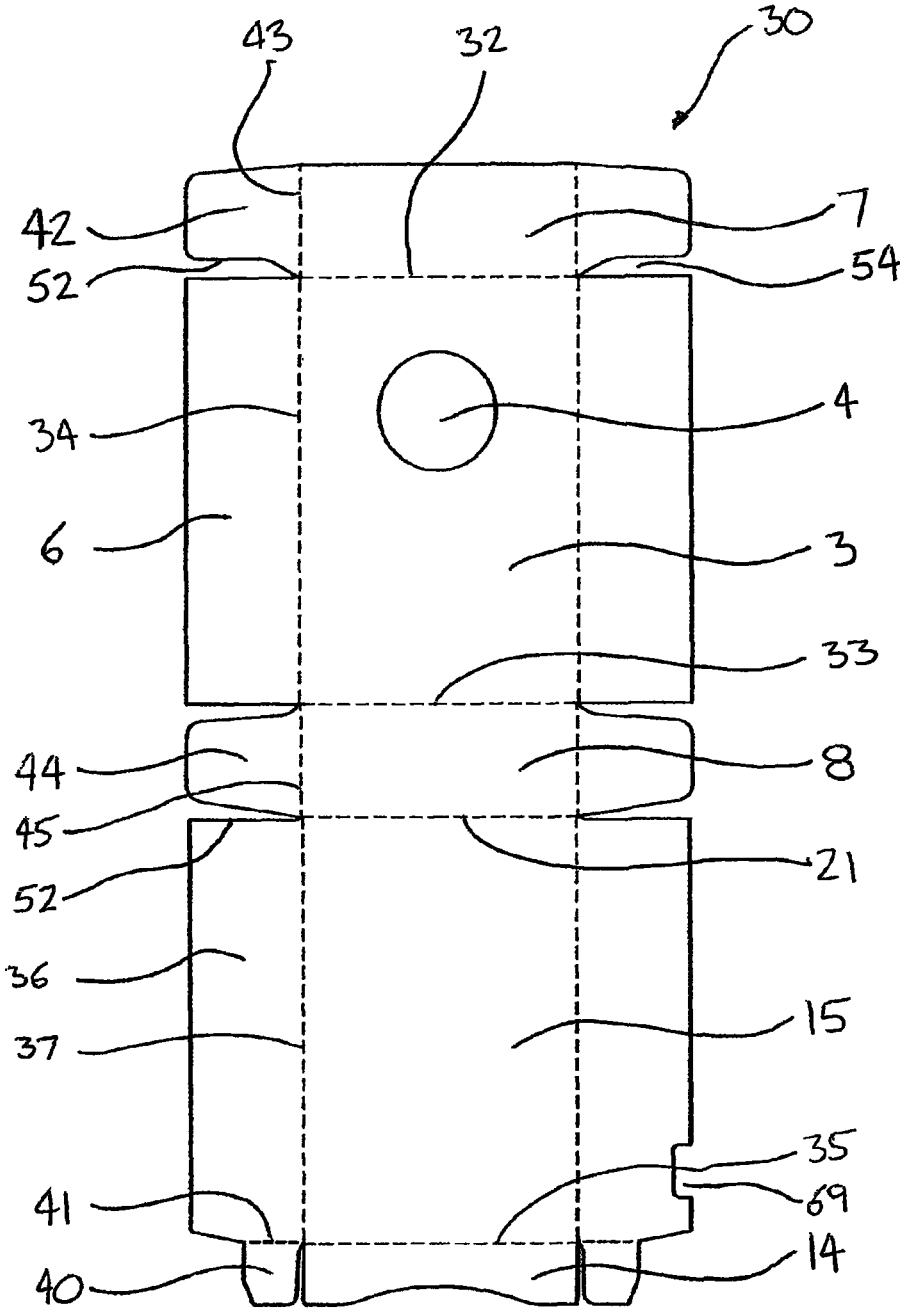
FIG. 2 is a plan view of the blank used to form the outer frame of the package shown in FIG. 1.
Figure 3:
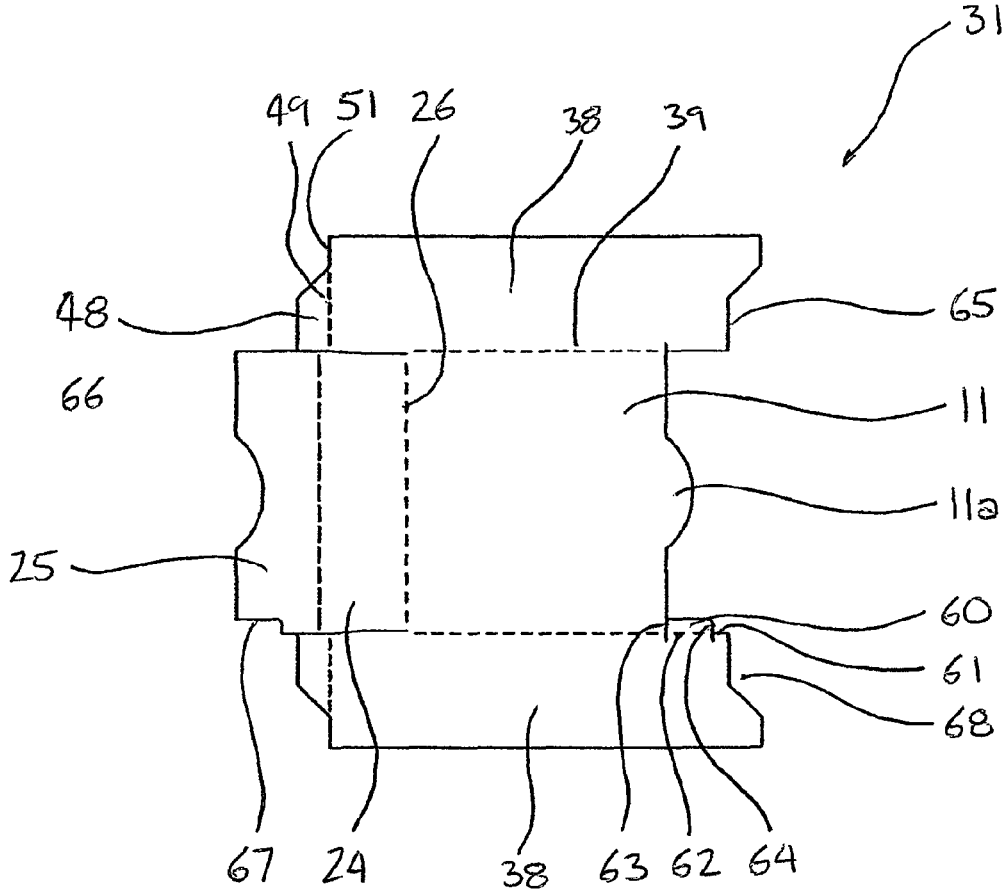
FIG. 3 is a plan view of the blank used to form the inner frame of the package shown in FIG. 1.

In the exemplary embodiment described above, the outer shell 1 and inner shell 2 are together formed from a pair of blanks 30, 31 as shown in FIGS. 2 and 3. In FIGS. 2 and 3, the solid lines define cut lines and the broken lines define fold lines. The first blank 30 is shown in FIG. 2 and comprises panels pertaining to both inner and outer shells 1, 2, namely the outer shell front wall 3, with the outer shell top, bottom and side walls 7, 8, 6 extending from the outer shell front wall 3 along fold lines 32, 33, 34 respectively, as well as inner shell rear and top walls 15, 14 communicating along a fourth fold line 35. Similarly, the second blank 31 is shown in FIG. 3 and comprises panels pertaining to both inner and outer shells 1, 2, in particular, the front wall 11 of the inner shell 2. The spring member 23 is also formed from the second blank 31, extending from the front wall 11 of the inner shell 2 along the second hinge line 26.

The inner shell sidewalls 13 are formed from first inner shell side flaps 36 extending from the inner shell rear wall 15 along fold lines 37 and second inner shell side flaps 38 extending from the inner shell front wall 11 along fold lines 39. When the package is assembled, the first inner shell side flaps 36 extending from the inner shell rear wall 15 overlap the second inner shell side flaps 38 extending from the inner shell front wall 11 and are fixedly mounted thereto by means of an adhesive to form the inner shell sidewalls 13.

Inner shell mounting flaps 40 extend from the first inner shell side flaps 36 along a fold line 41 extending transversely to the fold line 37 between the first inner shell side flaps 36 and the inner shell rear face 15, proximate to the inner shell top face 14. When the package is assembled, the inner shell top wall 14 overlaps the inner shell top wall mounting flaps 40 and is fixedly mounted to each flap 40 by means of an adhesive.

Similarly, upper outer shell mounting flaps 42 extend from the top wall 7 of the outer shell 1 along a fold line 43 extending transversely to the fold line 32 between the top wall 7 and front wall 3 of the outer shell 1. When the package is assembled, the outer shell sidewalls 6 overlap the respective upper outer shell mounting flap 42 and are fixedly mounted thereto by means of an adhesive such that a joining edge 46 is formed and the outer shell sidewalls 6 extend transversely from the top wall 7. Lower outer shell mounting flaps 44 also extend from the bottom wall 8 of the outer shell along a fold line 45 extending transversely to the fold line 33 between the bottom wall 8 and front wall 3 of the outer shell 1. When the package is assembled, the outer shell sidewalls 6 overlap a respective lower outer shell mounting flap 44 and are fixedly mounted thereto by means of an adhesive.

Although in the above described embodiment, the bottom wall 8 is fixedly mounted by means of the lower outer shell mounting flaps 44 being fixedly mounted to the outer shell sidewalls to form a bottom wall 8 of the outer shell 1, such that the outer and inner shells 1,2 hinge about the hinge line 21, it will be understood by a person skilled in the art that the invention is not limited thereto and that the bottom wall 8 may be fixedly mounted to the inner shell sidewalls 13 by means of the lower outer shell mounting flaps 44 being fixedly mounted to the inner shell sidewalls 13 to form a bottom wall of the inner shell 2. In this embodiment, the inner and outer shells 2,1 hinge about the fold line 33.

Retaining flaps 48 are formed extending from a lower fold line 49 of the second inner shell side flaps 38. When the package is assembled, a lower edge 51 of the second inner shell side flap 38 is aligned with a lower edge 52 of the first inner shell side flap 36 such that the retaining flaps 48 extend from the inner shell sidewalls 13. The retaining flaps 48 extend inwardly from the inner shell sidewalls 13 toward each other to support smoking articles in the smoking article receiving space 19, as will be explained hereinafter.

A cut-out 54 is formed in each upper outer shell mounting flap 42 along one side thereof. Although, in the Figures, a cut-out 54 is shown in each upper outer shell mounting flap 42, it will be apparent that a cut-out 54 may be formed in only one of the upper outer shell mounting flaps 42 to communicate with a tab, as will be explained hereinafter. When the package is assembled, each cut-out 54 forms a recess 56 on the inner surface of each outer shell sidewall 6. Herein, each cut-out 54 defines a step between an edge of each cut-out 54 and the inner surface of each outer shell sidewall 6 and each recess 56 is defined between the step and the inner face of the front wall 3. A portion of the inner surface of each outer shell sidewall 7 defines the base of each recess 56.

The step defined by each cut-out 54 is formed parallel to the inner face of the front wall 3, for reasons that will become apparent hereinafter.

Referring now to FIGS. 1 and 3, the package comprises a tab 60 extending sideways from one of the inner shell sidewalls 13. The tab 60 extends perpendicular to the inner shell sidewall 13, parallel to the inner shell front wall 11 and along the same plane thereof. Each tab 60 is formed extending from an inner side edge 61 of one second inner shell side flap 38, along a fold line 62. The tab 60 is formed from the same resilient material as the inner shell, for reasons that will become apparent hereinafter. Cut lines 63,64 define tab outer side edges and extend to the fold line such that the tab 60 is resiliently hinged thereabout. The tab 60 also has rounded corners (not shown).

It is noted from FIG. 3 that the first outer edge 65 of the second blank 31 correlates to the second outer edge 66 of the second blank, such that the outer edges 65, 66 tessellate with each other and therefore, when a first outer edge 65 of a second blank 31 is cut, the second edge 66 of an adjacent second blank 31 is formed. In particular, the second outer edge 66 is formed with a recess 67 formed therein which corresponds to the tab 60 extending on the first outer edge 65, and the first outer edge 65 has a pair of recesses 68 that correspond to the retaining flaps 48 formed on the second outer edge 66.

An indentation 69 is formed in one of the first inner shell side flaps 36 along a side edge 70, which correlates with the position of the tab 60 extending from the corresponding second inner shell side flap 38, such that it aligns therewith and allows the tab 60 to pivot without contacting the respective first inner shell side flap 38.

Operation of the package according to the present invention will now be described with reference to FIG. 1.

The package is assembled and smoking articles, such as cigarettes (not shown), are disposed in the smoking article receiving space 19. When the package is in the open position, wherein the inner shell 2 is rotated with respect to the outer shell 1 and the smoking article receiving space 19 is accessible, the spring member 23 biases the inner shell 2 away from the outer shell 1. To move the package into a closed position, the inner shell is rotated about the hinge line 21 and urged into a cavity in the outer shell 1 defined by the front, top, bottom and side walls 3,5,6,7,8.

The sidewalls 13 of the inner shell 2 move relative to the sidewalls 5, 6 of the outer shell 1 such that the tab 60, extending from one sidewall 13 of the inner shell 2 contacts the respective sidewall 6 of the outer shell 1. The tab 60 is resiliently deformed and acts against the inner surface of the outer shell sidewall 6. As the inner shell 2 is further pivoted with respect to the outer shell 1, the tab 60 acts against the step defined by the upper outer shell mounting flap 42 and springs into the recess 56 due to the resilience of the tab 60.

An advantage of the tab 60 locating in the recess 56 is that the inner shell 2 is securely held in the outer shell 1 by means thereof. Additionally, as the tab 60 springs into the recess 56 an audible sound is produced, and the tab 60 clicks into the recess 56.

When a user wants to obtain a smoking article (not shown) disposed in the package, the user holds the outer shell 1 of the package and pushes the front face 11 of the inner shell 2 through the aperture 4 to pivot the inner shell 2 relative thereto. A protrusion 11*a* of the inner shell front face 11 may be formed such that the aperture 4 overlaps the protrusion 11*a* and a user may push thereagainst. The tab 60 acts against the step and so the inner shell 2 is restricted from pivoting relative to the outer shell 1. As the force applied to the inner shell is increased, one or more of the tab 60, respective sidewall 6 of the outer shell 2 or sidewall 13 of the inner shell 2 is resiliently deformed and the tab 60 is released from the recess 54.

Additionally, as the sidewall 13 of the inner shell 2 rotates relative to the sidewall 6 of the outer shell 1, the tab is disposed therebetween such that there is frictional resistance produced between the outer shell 1 and the inner shell 2.

Figure 4:
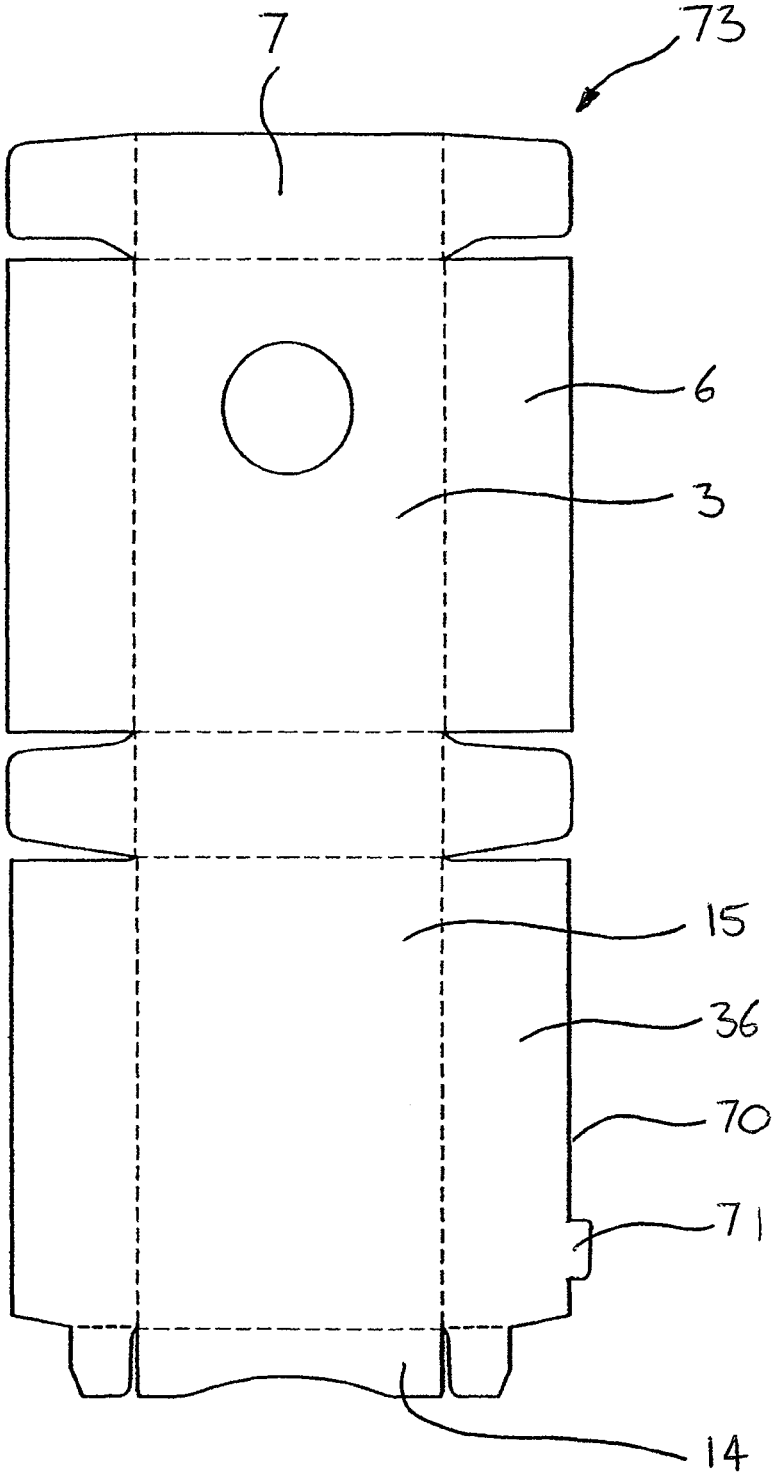
FIG. 4 is a plan view of the blank used to form the outer frame of the package in accordance with another exemplary embodiment of the invention.
Figure 5:
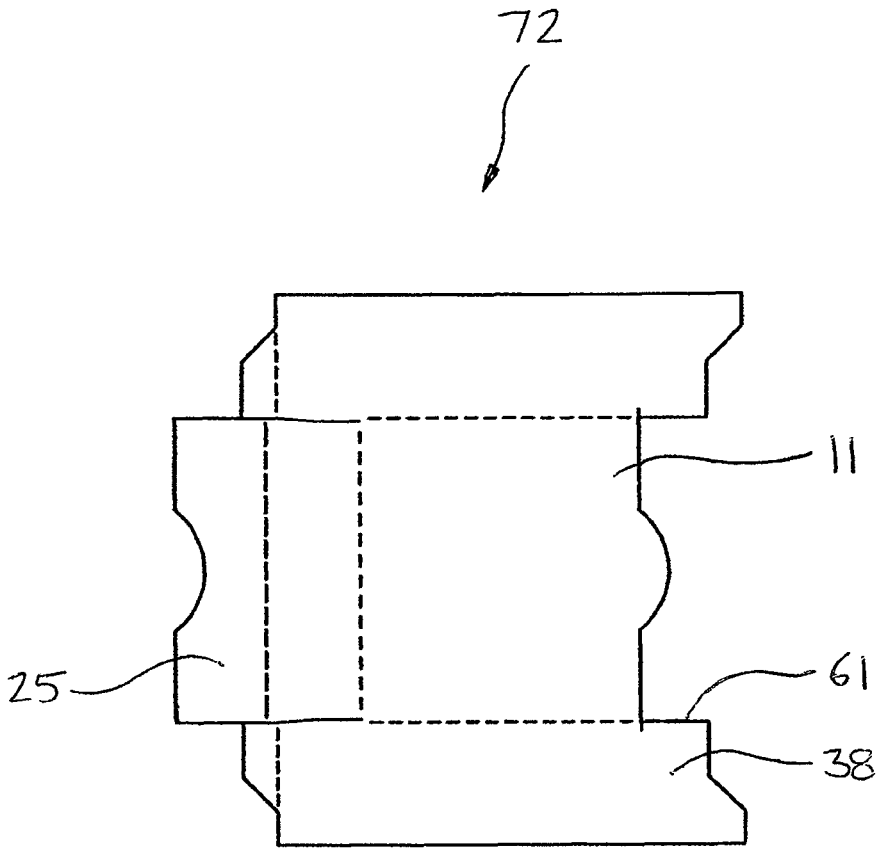
FIG. 5 is a plan view of the blank used to form the inner frame of the package shown in FIG. 4.

An alternative embodiment of the invention is shown in FIGS. 4 and 5. The package according to this embodiment of the invention is generally the same as the package described above and so detailed description will be omitted herein. However, in this embodiment a tab 71 extends from the side edge 70 of one of the first inner shell side flaps 36, such that the tab 60 disposed on a second blank 72 is omitted and the tab 71 is formed on a first blank 73.

Further, although tabs 60,71 are shown in the above exemplary embodiments to extend sideways from the edge of the front wall 11 of the inner shell 2, the invention is not limited thereto and the tab 60,71 may project perpendicularly from the face of the sidewalls 13 of the inner shell 2 distal from front wall 11. Additionally, in the above exemplary embodiments the package is formed from a first and second blank 30, in an alternative embodiment the package may be formed from a single blank or more than two blanks.

Figure 6:
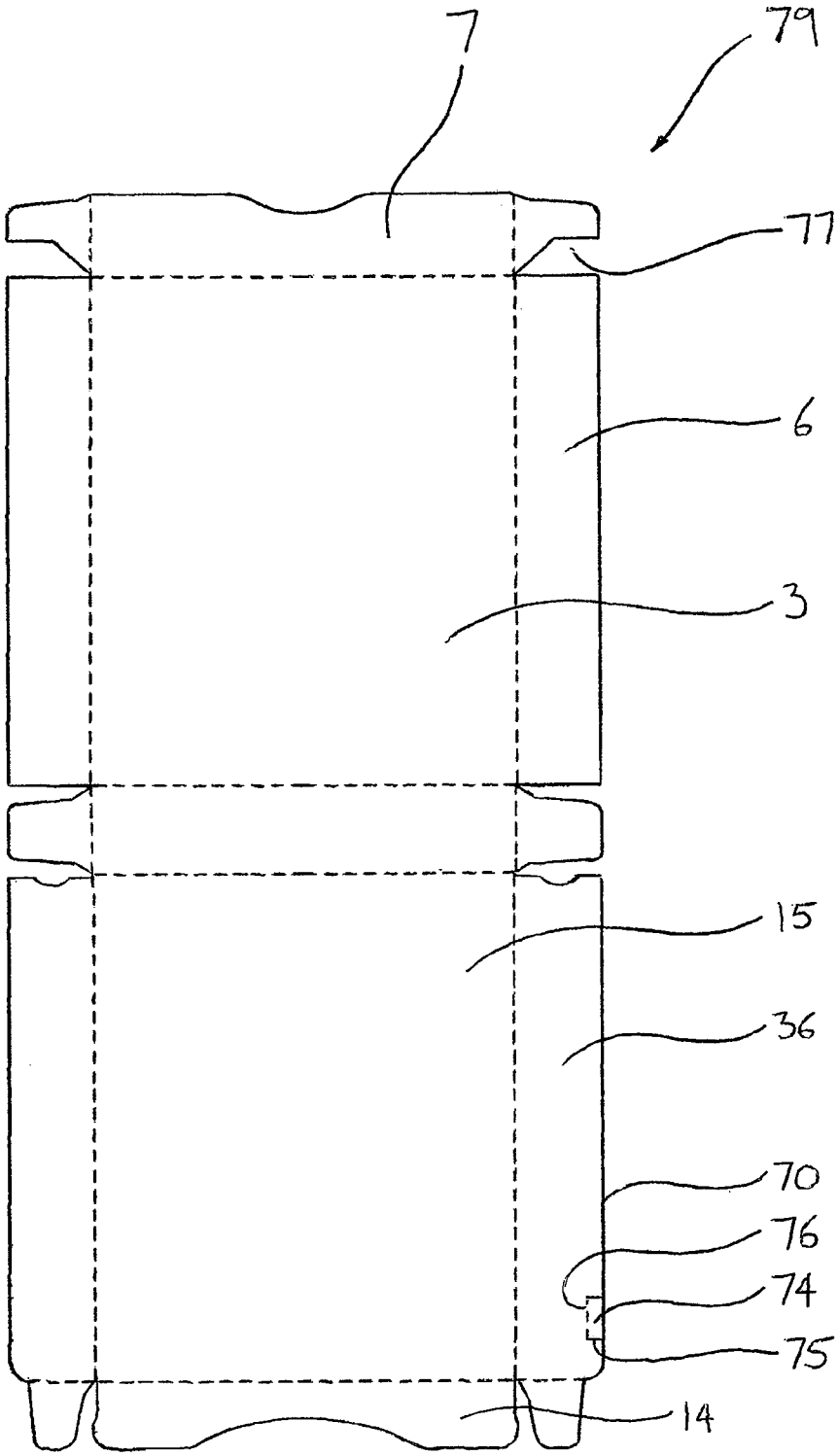
FIG. 6 is a plan view of the blank used to form the outer frame of the package in accordance with another exemplary embodiment of the invention.

An alternative embodiment of the invention is shown in FIG. 6. The package according to this embodiment of the invention is generally the same as the package described above and so detailed description will be omitted herein. However, in this embodiment a tab 74 is formed in one of the first inner shell side flaps 36. The tab 74 is formed by a pair of parallel cuts 75 extending perpendicularly from the side edge 70 of the first inner shell side flap 36. A tab fold line 76 extends between the ends of the parallel cuts 75 such that the tab 74 protrudes from the first inner shell side flap 36. The tab 74 locates in a corresponding enlarged recess 77 formed in a corresponding inner shell side wall 13.

An advantage of this embodiment is that the upper edge 78 of the tab 74 is parallel to the side edge 70 of the first inner shell side flap 36 when the blank 79 is formed which reduces waste.

Additionally, in a further embodiment, the tab 60,71,74 may not be formed to extend from one sidewall 13 of the inner shell 2 and may alternatively be formed to extend from the top wall 14 of the inner shell 2 to locate in a corresponding recess (not shown) formed in the top wall 7 of the outer shell 1. Furthermore, the tab 60, 71, 74 may alternatively extend from an outer shell side wall 6 to locate in a corresponding recess (not shown) formed in a corresponding inner shell side wall 13.

Although in the exemplary embodiments described above an tab 60,71,74 is shown extending from one sidewall 13 of the inner shell 2, it will be appreciated by a person skilled in the art that the invention is not limited thereto and that a tab 60,71,74 may be disposed to extend from each sidewall 13 of the inner shell 2 to communicate with corresponding recesses 54 formed on an inner surface of each opposing sidewall 6 of the outer shell 1, such that each tab 60,71,74 locates in each recess 54 and is held therein. Alternatively, a tab (not shown) may be disposed to extend from an inner surface of a sidewall 6 of the outer shell 1 to communicate with a corresponding recess (not shown) formed on a sidewall 13 of the inner shell 2, such that the tab (not shown) locates in the recess (not shown) and is held therein.

Although embodiments of the invention have been shown and described, it will be appreciated by those skilled in the art that variations may be made to the above exemplary embodiment that lie within the scope of the invention, as defined in the following claims

The invention claimed is:

1. A package for smoking articles, comprising:

an inner shell and an outer shell, the inner shell defining a space for smoking articles and the outer shell defining a cavity to receive the inner shell, the inner and outer shells being hingedly connected such that the inner and outer shells pivot relative to each other from a closed position in which the inner shell is received in the outer shell to an open position in which the inner shell extends from the outer shell, wherein the outer shell includes a side wall that overlaps a side wall of the inner shell when the inner and outer shells are in the closed position, a step being formed in the side wall of the outer shell defining a recess in said side wall and a tab extending from a corresponding side wall of the inner shell such that a free end of said tab extending from the corresponding side wall contacts the side wall in which the recess is formed when the inner and outer shells are pivoted towards the closed position, the tab locating over the step and springing into said recess when the closed position is reached, and wherein the outer shell comprises an end wall having a flap attached to a surface of the side wall, said step being formed by an edge of the flap and a surface of the side wall to which it is attached.

2. The package according to claim 1, wherein the inner and outer shells are hingedly connected to each other at one end, the space defined by the inner shell being accessible at an opposing end of the inner shell.

3. The package according to claim 1, wherein the outer shell has a front wall and the side wall extends from an edge of the front wall with the recess being formed between said step and the front wall of the outer shell.

4. The package according to claim 1, wherein the flap is configured so that said edge does not extend up to the front wall, said recess being formed between said edge and said front wall.

5. The package according to claim 1, wherein the flap is configured so that said edge extends parallel to said front wall.

6. The package according to claim 1, wherein the end wall extends from the front wall along a second edge and is substantially perpendicular to the side wall and the front wall.

7. The package according to claim 1, wherein the tab extends from a side wall of the inner shell in a direction towards the side wall of the outer shell.

8. The package according to claim 7,

Wherein the side wall of the inner shell is formed from inner and outer overlapping layers attached to each other.

9. The package according to claim 8, wherein the tab is integral with, and extends from, the inner layer.

10. The package according to claim 9, wherein a cut out is formed in the outer layer to receive the tab.

11. The package according to claim 8, wherein the tab extends from the outer layer.

12. The package according to claim 7, wherein the tab is positioned such that it contacts the flap and is resiliently deformed when the inner and outer shells pivot into a closed position prior to the tab being received in the recess.

13. The package according to claim 1, wherein the package is formed from two blanks attached to each other.

14. The package according to claim 13, wherein a first blank of the two blanks comprises a pair of opposing edge cuts, wherein the opposing edge cuts tessellate with each other.

15. The package according to claim 14, wherein the tab is formed on one edge cut of the first blank and a corresponding cut-out is formed in the outer edge, such that both the tab and the cut-out tessellate.

16. The package according to claim 1, wherein the side wall is an end wall.

17. The package according to claim 1, wherein the recess is formed in the side wall of the inner shell and the tab extends from the side wall of the outer shell.

18. The package according to claim 1, wherein the outer shell and inner shell are connected by a hinge member, such that the inner shell springs between the open position and the closed position.

19. The package according to claim 1, wherein the outer shell comprises a pair of opposing side walls that overlap corresponding opposing side walls of the inner shell when the inner and outer shells are in the closed position, wherein each wall has a recess formed thereon and a tab extends from each face, such that when the inner and outer shells are in the closed position, the tabs locate in said recesses.

20. The package according to claim 1 containing smoking articles.

21. A package for smoking articles, comprising:

an inner shell and an outer shell, the inner shell defining a space for smoking articles and the outer shell defining a cavity to receive the inner shell, the inner and outer shells being hingedly connected such that the inner and outer shells pivot relative to each other from a closed position in which the inner shell is received in the outer shell to an open position in which the inner shell extends from the outer shell, wherein the outer shell includes a side wall that overlaps a side wall of the inner shell when the inner and outer shells are in the closed position, a step being formed in the side wall of the inner shell defining a recess in said side wall and a tab extending from a corresponding side wall of the outer shell such that a free end of said tab extending from the corresponding side wall contacts the side wall in which the recess is formed when the inner and outer shells are pivoted towards the closed position, the tab locating over the step and springing into said recess when the closed position is reached, and wherein the inner shell comprises an end wall having a flap attached to a surface of the side wall, said step being formed by an edge of the flap and a surface of the side wall to which it is attached.

22. The package according to claim 21, wherein the inner and outer shells are hingedly connected to each other at one end, the space defined by the inner shell being accessible at an opposing end of the inner shell.

23. The package according to claim 21, wherein the inner shell has a front wall and the side wall extends from an edge of the front wall with the recess being formed between said step and the front wall of the outer shell.

24. The package according to claim 21, wherein the flap is configured so that said edge does not extend up to the front wall, said recess being formed between said edge and said front wall.

25. The package according to claim 21, wherein the flap is configured so that said edge extends parallel to said front wall.

26. The package according to claim 21, wherein the end wall extends from the front wall along a second edge and is substantially perpendicular to the side wall and the front wall.

27. The package according to claim 21, wherein the tab extends from a side wall of the outer shell in a direction towards the side wall of the inner shell.

28. The package according to claim 27, wherein the side wall of the outer shell is formed from inner and outer overlapping layers attached to each other.

29. The package according to claim 28, wherein the tab is integral with, and extends from, the outer layer.

30. The package according to claim 29, wherein a cut out is formed in the inner layer to receive the tab.

31. The package according to claim 28, wherein the tab extends from the outer layer.

32. The package according to claim 27, wherein the tab is positioned such that it contacts the flap and is resiliently deformed when the outer and inner shells pivot into a closed position prior to the tab being received in the recess.

33. The package according to claim 21, wherein the package is formed from two blanks attached to each other.

34. The package according to claim 33, wherein a first blank of the two blanks comprises a pair of opposing edge cuts that tessellate with each other.

35. The package according to claim 34, wherein the tab is formed on one edge cut of the first blank and a corresponding cut-out is formed in the outer edge, such that the tab and the cut-out tessellate.

36. The package according to claim 21, wherein the side wall is an end wall.

37. The package according to claim 21, wherein the outer shell and inner shell are connected by a hinge member, such that the inner shell springs between the open position and the closed position.

38. The package according to claim 21, wherein the outer shell comprises a pair of opposing side walls that overlap corresponding opposing side walls of the inner shell when the inner and outer shells are in the closed position, and wherein each wall has a recess formed thereon and a tab extending from each face, such that the tabs locate in said recesses when the inner and outer shells are in the closed position.

39. The package according to claim 21 containing smoking articles.

* * * * *